United States Patent [19]

Björklund

[11] Patent Number: 4,783,854

[45] Date of Patent: Nov. 15, 1988

[54] FOLDED PROTECTIVE GARMENT

[75] Inventor: Mats Björklund, Sundbyberg, Sweden

[73] Assignee: Landstingens Inkopscentral Lic, Ekonomisk Forening, Solna, Sweden

[21] Appl. No.: 149,077

[22] Filed: Feb. 1, 1988

[30] Foreign Application Priority Data

Feb. 26, 1987 [SE] Sweden ..... 8700818-1

[51] Int. Cl.[4] ..... A41B 13/10

[52] U.S. Cl. ..... 2/51; 2/114

[58] Field of Search ..... 2/51, 114, DIG. 7, 69

[56] References Cited

U.S. PATENT DOCUMENTS

| | | | |
|---|---|---|---|
| 3,625,206 | 12/1971 | Charnley | 2 X |
| 3,721,999 | 3/1973 | Goya et al. | 2/114 |
| 3,935,596 | 2/1976 | Allen, Jr. et al. | 2/114 |
| 4,523,335 | 6/1985 | Scrivens | 2/114 X |

FOREIGN PATENT DOCUMENTS

| | | |
|---|---|---|
| 2329219 | 5/1977 | France . |
| 2469135 | 5/1981 | France . |

*Primary Examiner*—Louis K. Rimrodt
*Assistant Examiner*—J. L. Olds
*Attorney, Agent, or Firm*—Young & Thompson

[57] ABSTRACT

A folded protective garment is enclosed in a wrapping maintaining sterility. The folded garment has its entry opening at one edge of the package formed by the folded garment. The entry opening is surrounded by a collar obtained by turning the edge portion of the garment inside out so that the outside of the collar is formed by the inside of the garment. For the remainder, the garment is folded such that the outside of the collar has uncovered surfaces which can be gripped by unprotected hands when the garment is folded out and put on, the garment also having front and back portions which are alike and joined together at the edges.

6 Claims, 8 Drawing Sheets

FOLDED PROTECTIVE GARMENT

The present invention relates to such protective garments as are used in hospitals, particularly during operations. Such garments are delivered folded and enclosed in a wrapping maintaining sterility, hereinafter referred to as a sterility wrapping.

At present the most usual protective garment is a disposable-type gown which is thrown away after use, or a gown which is washed after use and may be used several times. The back of the gown is made in two halves which may mutually overlap, and is kept in place with the aid of tying ribbons or other fastening means. The gown is folded into a package in the sterility wrapping, which usually comprises two plastics films welded together along their edges, which may be torn apart to release the contents of the wrapping. In certain cases, the folded gown is wrapped in protective paper. The doctor or other person who is to put the gown on cannot do this alone with his unprotected hands and must therefore have assistance.

An essential disadvantage with the known, folded protective gown is thus that it requires an extra person to help the user put the gown on.

The object of the present invention is to eliminate this disadvantage by having a protective garment in the wrapping folded in such a manner that the garment can be opened out by the user without his unprotected hands needing to come into contact with the surfaces forming the outside of the garment when he has put the garment on, the garment being of such design that the user can lift it above his head with his hands and arms and take the garment over his head and body into the position of use.

In order to avoid the disadvantages with a gown of the kind described above, the folded protective garment in accordance with the invention in the wrapping is of the kind known per se, in which the front and back are substantially alike and are mutually attached at their edges while leaving openings for the passage of the wearer's body at the lower end of the garment, his head at the upper end and hands at the ends of the sleeves, the garment in its folded-out state having a length reaching down to at least cover the trunk of the user. This garment is folded in accordance with the invention into a package lying inside the wrapping. A suitable embodiment of the folded garment in accordance with the invention is distinguished in that both the front and back of the garment at its lower end portion is folded outwards and backwards to form a collar around the lower entry opening. The outside of the collar will thus be the inside of the garment. The width of the collar in the longitudinal direction of the garment is such that a hand may grip about the outer and folded end edge of the collar without the fingers reaching over the collar and coming into contact with the remaining portions of the garment. It is acceptable if the user comes into contact with the outside of the collar, since the outside of the collar will form a portion of the inwardly facing side of the garment after folding down the collar when the user has put the garment on. In addition, the garment is preferably folded in such a way that the outer end edge portion of the collar is folded laterally about at least one folding line parallel to the longitudinal direction of the garment such that the thus-folded end edge will form one side edge of the package or folded garment. The outer end edge of the collar is situated around the entry opening the user is to thrust into when he puts the garment on. When the user puts the garment on, he can thus take hold of the collar and put his hands into the opening situated at the side edge of the package. The folded garment can then be lifted up with the hands such that the garment folds out, allowing hands and arms to thrust further into it, after which it can be lifted up further and eased down over the head simultaneously as the arms are moved out into its sleeves and it falls down around the waist of the user. All these operations can be carried out without the user's fingers coming into contact with the outside of the garment. Since the garment has the shape of a long shirt, it is not necessary to have any fastening ribbons to tie the garment together.

These and other distinguishing details and advantages of the invention will be described in more detail in some embodiments illustrated on the accompanying drawings of a protective garment folded in accordance with the invention and kept in a wrapping.

Figure 16:
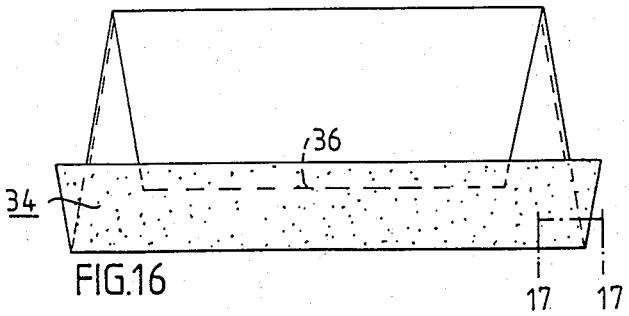

FIG. 16 further illustrates downward folding of the upper portion of the garment with the sleeves, and the lower end portions of the front and back folded to form a collar.

Figure 17:
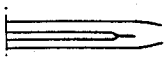

FIG. 17 is a section along the line 17—17 in FIG. 16 for illustrating that the relatively narrow collar in this case can be slit at its end edges.

Figure 4:
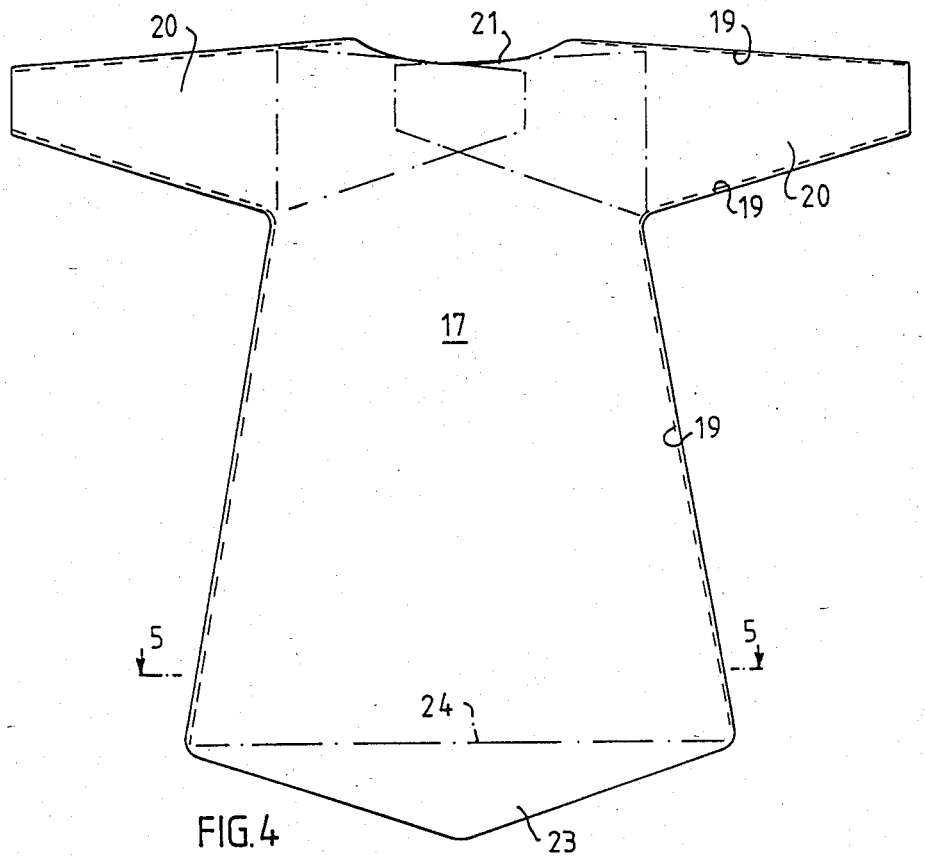
FIG. 4 illustrates the garment in a foldedout state.
Figure 5:
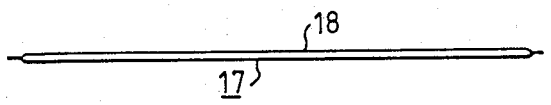
FIG. 5 is a section along the line 5—5 in FIG. 4.
Figure 18:
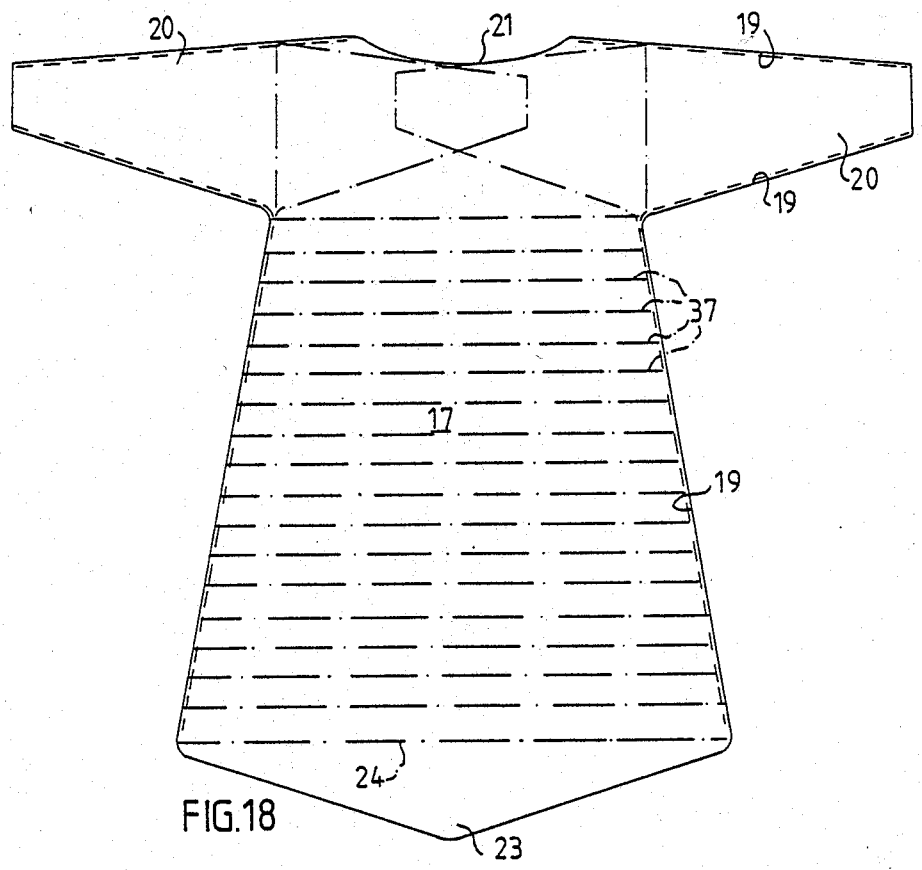
Figure 19:
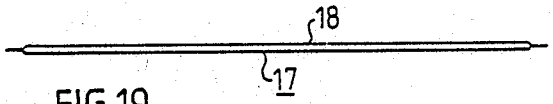

FIGS. 18 and 19 are the same Figures as in FIGS. 4 and 5, although here a large number of transverse chain-dotted lines are depicted in FIG. 18 to denote where the front and back of the garment are folded when the side edges are pleated.

Figure 20:
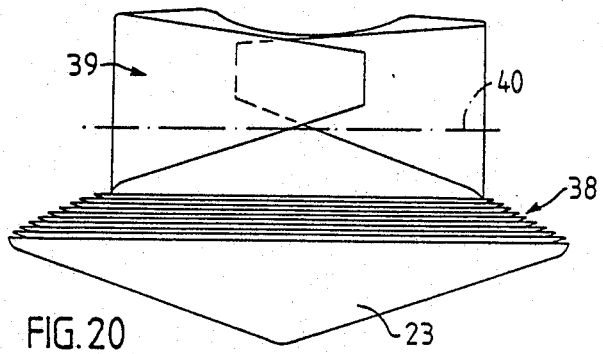

FIG. 20 illustrates how the garment has been folded together and that the sleeves have been folded in over each other.

Figure 21:
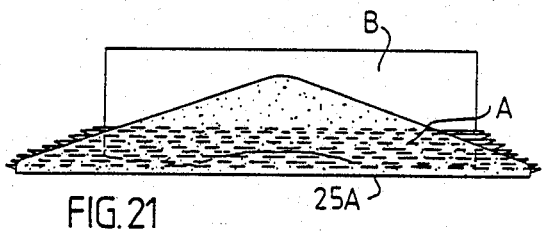

FIG. 21 illustrates the portion with the sleeves folded double and the flaps at the lower end of the garment folded up.

Figure 22:
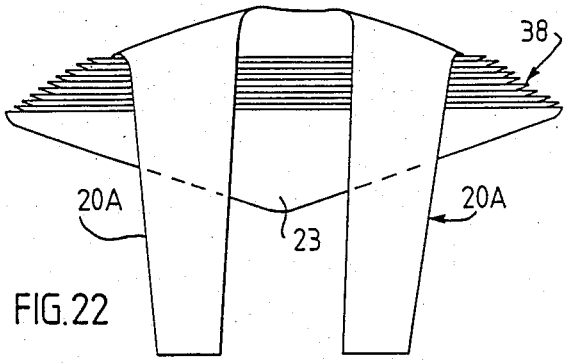

FIG. 22 is a section of the garment in FIG. 20, with the difference that the sleeves have not been folded in but have been turned inside out and pulled out at the lower end of the garment.

Figure 23:
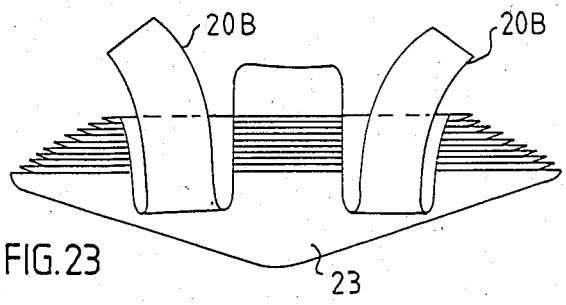

FIG. 23 is a section illustrating how the sleeves in FIG. 23 have been turned inside out along a part of their length to form two muffs.

Figure 24:
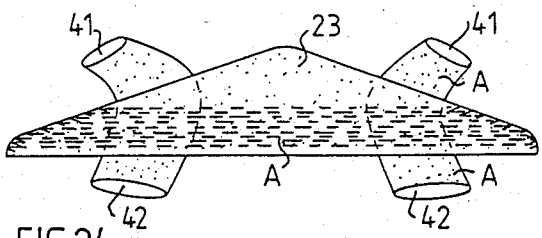

FIG. 24 illustrates the folded or pleated garment in FIG. 23 after folding up the end flaps and with the muffs projecting out upwardly and downwardly in the Figure.

Figure 1:
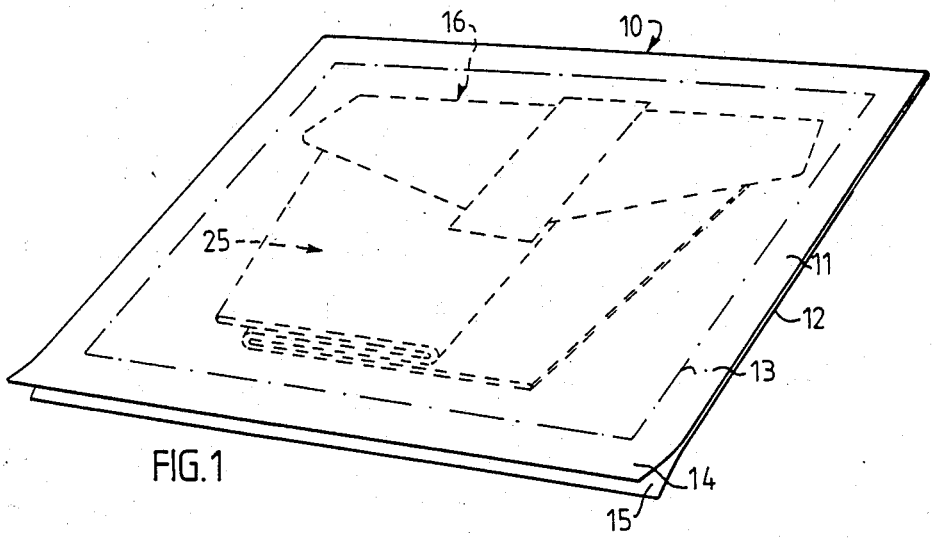
FIG. 1 is a schematic, perspective view of a wrapping containing a protective garment folded in accordance with the invention, and of the embodiment illustrated in FIG. 4.

The wrapping 10 illustrated in FIG. 1 maintains sterility and conventionally comprises two plastics films 11 and 12 which are joined along a frame 13 by welding. Along one side edge there are two gripping flaps 14,15. The weld is yielding, such as to open when the flaps are drawn away from each other.

Figure 3:
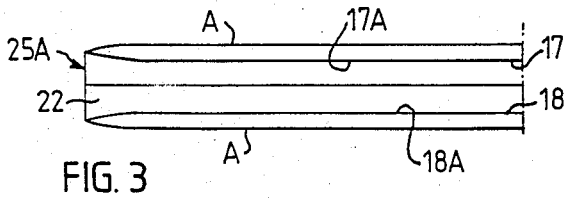
FIG. 3 is a section along the line 3—3 in FIG. 2.

Inside the wrapping there is a protective garment 16 which is folded in accordance with the invention, and in its folded condition it forms a package within the wrapping. The garment is illustrated in FIG. 4 in its folded out state and comprises a front 17 and back 18 of non-woven material, which are fastened along certain portions 19 of their edges by welding or sewing such as to leave openings at the ends of the sleeves 20 for the user's hands, and an opening 21 at the upper end of the garment for the user's head. The lower end of the garment has an entry opening 22 (FIG. 3) so that it can be put on in the same way as a dress.

Figure 15:
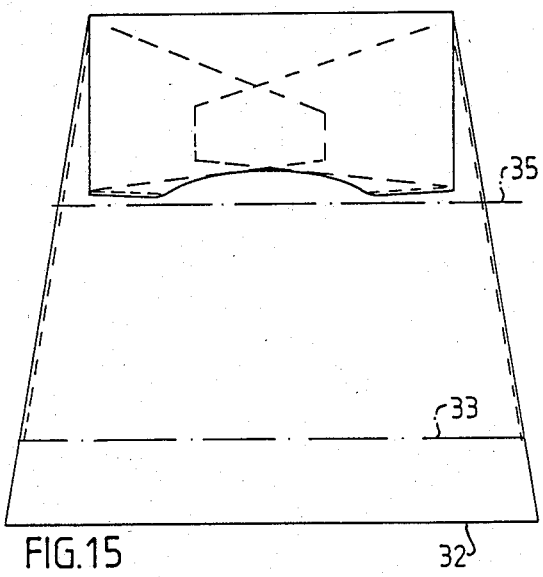
FIG. 15 illustrates an alternative embodiment of the garment with a lower end edge cut straight and in a folding situation with the sleeves folded inwards and the upper portion of the garment folded down.

The lower end portions of the front and back are each extended with a flap 23 in the illustrated embodiment, but the end portions can also be cut off straight as indicated by the chain-dotted line 24. The latter embodiment is illustrated in FIGS. 15–17.

Distinguishing for the folded garment is that it has been folded in accordance with the invention in a manner such that the folded garment 16 inside the wrapping 10 always has a narrower or wider collar 25 obtained by turning the lower end edge portion of the garment inside out and folding it against the rest of the garment so that the outside of collar 25 will be the inside of the garment, which is denoted by dotted areas in the appropriate Figures.

This collar 25 is situated along one side edge of the folded garment, where the collar is folded forwards and backwards sideways in a desired manner to reduce the size of the package formed by the folded garment in the wrapping. The outer end edge 25A of the collar thus lies around the entry opening 22 to the garment.

To enable the user to grip the folded garment with his unprotected hands, which could cause contamination of the surfaces they come into contact with, the collar forms uncovered surfaces A (those denoted by dots) which can be gripped with the hands without risk. The width of these surfaces from the outer end edge of the collar is so great that it is possible conveniently to grip the outer end edge of the collar without coming into contact with the more remotely situated surfaces B which are on the outside of the garment.

Figure 2:
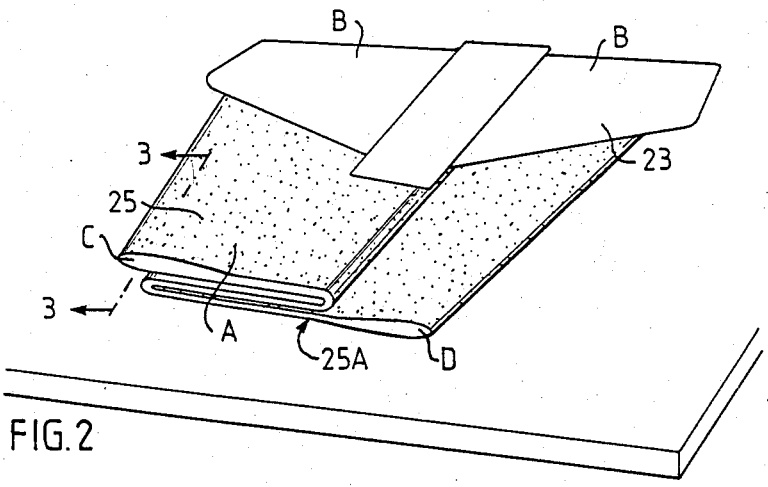
FIG. 2 illustrates the folded garment taken from the wrapping and lying on a table.
Figure 7:
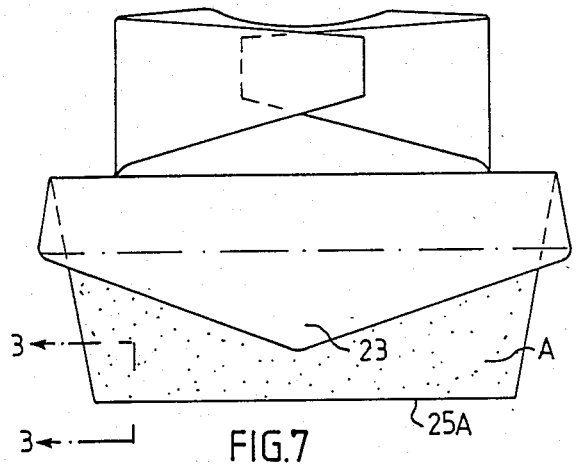
Figure 11:
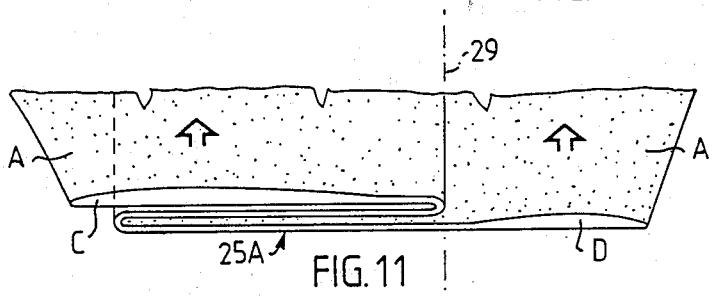
FIG. 11 is a perspective, enlarged fragmentary end view of the end edge portion of the folded garment, where the user is to insert his hands and arms for putting on the garment.
Figure 14:
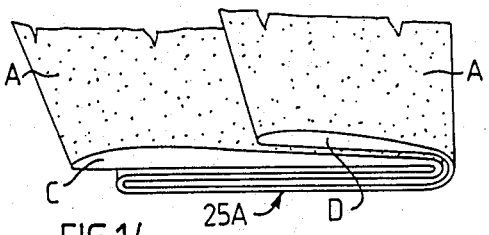
FIG. 14 is a perspective, enlarged fragmentary end view of the folded garment in FIG. 13.

In order to put on the folded garment, the user grips the outer end edge 25A of the collar 25 and puts in his hands at the two places C and D in FIGS. 2 and 11, where both the insides 17A and 18A of the entry opening 22 and the outside A (FIG. 3) in the areas of the free surfaces of the collar are on the inside of the garment. The user puts in his hands at the places C and D in FIGS. 2 and 11 or at C and D in FIG. 14, whereupon the garment is lifted up so that it becomes unfolded while the hands are moved sideways and the arms are thrust into the garment. Finally, the garment is moved upwards so that the user can put in his head and arms far enough for his head to come through the head opening 21 and the arms into the sleeves 20. While this is being done, the garment falls downwards along the trunk of the user. It is usually only necessary to shake the body a little so that the garment falls down to an entirely folded-out state, but if necessary the flaps 23 (FIG. 7) can be gripped to straighten out the garment.

Figure 6:
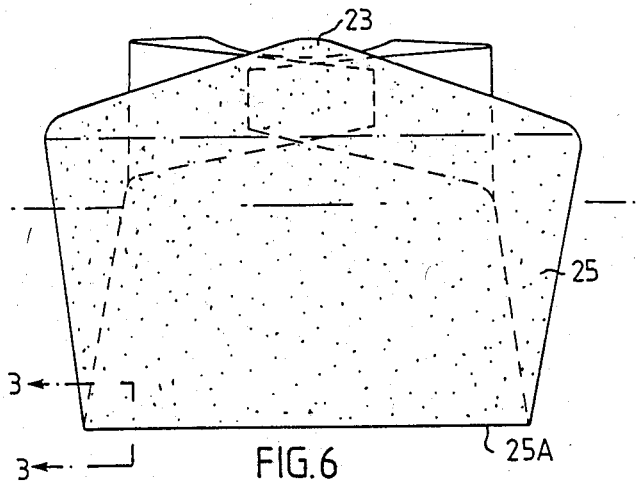
FIGS. 6-9 illustrate different folding operations to arrive at the folded garment in FIGS. 10 and 2, respectively.

The garment in FIG. 4 is folded by beginning with folding in the sleeves 20, and then turning the lower edge portion inside out into a collar 25 which is pulled up into the position illustrated in FIG. 6. In this embodiment, the collar has two flaps 23 which are folded down from the positionin FIG. 6 to the position in FIG. 7 such as to leave the required free surfaces A on the outside of the collar, i.e. the areas denoted by dots which are on the inside of the garment when it has been put on.

Figure 8:
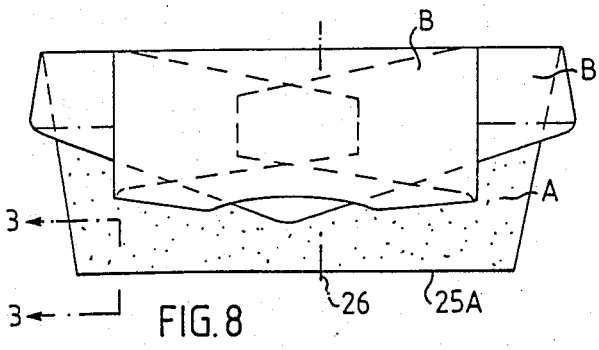
Figure 9:
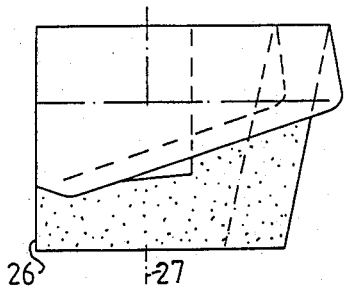

In FIG. 8 the portion with the sleeves has been folded down over one of the flaps 23. A folding line 26 has been indicated in this Figure by a chain-dotted line which is substantially parallel to the longitudinal direction of the garment, or substantially at right angles to the outer end edge 25A of the collar. By folding sideways about this folding line the intermediate position illustrated in FIG. 9 is reached, where a further folding line 27 is denoted by a chain-dotted line. By folding sideways back again about this line the position in FIG. 10 is reached, corresponding to the folded garment illustrated in FIG. 2.

Figure 10:
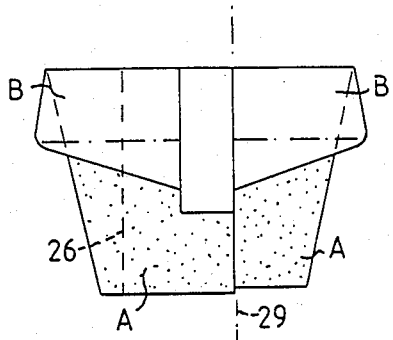
Figure 12:
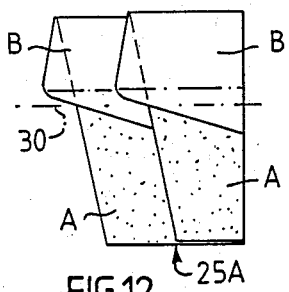
FIG. 12 illustrates further alternative folding of the folded garment in FIG. 10 for reducing the size of the package.

If so desired, the sideways folding can be continued about a folding line 29 in FIGS. 10 and 11 to reduce the size of the package. As illustrated in FIG. 12, the free surfaces A of the collar are of a generous size to allow being gripped with the hands without the latter coming into contact with portions B, which are on the outside of the garment when it is in use.

Figure 13:
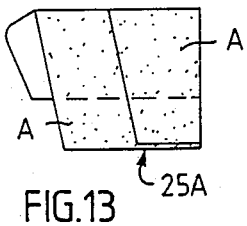
FIG. 13 illustrates further alternative folding backwards of the garment in FIG. 12 for decreasing still further the size of the folded garment.

However, the size of the future packet can be further decreased if the upper portion in FIG. 12 is folded backwards about the folding line 30, to form the small package in FIG. 13.

A protective garment of the same embodiment as the one in FIG. 4 is illustrated in FIG. 15, but with the difference that the lower end edge 32 of the garment is cut off straight. The sleeves are folded inwards and the corresponding portion of the garment folded down. A folding line 33 is indicated in FIG. 15, and the lower end portions of the front and back are folded up about this line to form the collar 34 illustrated in FIG. 16, this collar having substantially less width than the collar in FIG. 6.

The upper portion in FIG. 15 has been turned down about a folding line 35 in FIG. 16. In this Figure the end edge 36 of the downwardly folded portion is under the collar 34, but it can also lie on top of the collar without any drawback.

To facilitate downwardly folding the collar 34 when putting on the garment, the collar can be slit at either end edge, which is illustrated in FIG. 15 by the seam or weld 19 not going all the way down to the end edge 32, which is also illustrated in the section in FIG. 17.

Transverse chain-dotted lines 37 are indicated in FIG. 18 to illustrate where the front 17 and back 18 are folded if the side edges of the garment are wrinkled.

In FIG. 20 it will be seen how the front and back have been pleated into a bellows-like packet 38. The sleeves 20 have been folded in over each other and this sleeve portion 39 has then been folded double downwards along a folding line 40, whereafter both end flaps 23 have been folded up into the position illustrated in FIG. 21. The hands can now be taken into the entry opening end edge 25A to fold out the sleeve portion 39 and to thrust the hands into the sleeves. The folded or pleated garment in FIG. 21 can, as previously, be folded sideways once or more times to reduce the size of the folded garment in the wrapping.

A folding modification is illustrated in FIG. 22. In this Figure there is the bellows-like 38, as in Fig 20, but instead of folding the sleeves in on top of each other according to FIG. 20, the sleeves have been turned inside out and these sleeves 20A have been pulled down through the packet 38. From this position the sleeves 20A have been turned inside out along a portion of their length to form two muffs 20B according to FIG. 24.

Finally, in FIG. 24 it is illustrated how the end flaps 23 have been folded up over the bellows-like packet 38.

In FIG. 24, it is also shown how the ends 41,42 of each muff are completely free so that the hands can conveniently be inserted into the ends 42 and out through the ends 41 without coming into contact with the rest of the garment. The folded garment in FIG. 24 is suitably folded once or more times sideways in the same way as described above.

I claim:

1. A folded, protective garment, which is enclosed in a wrapping maintaining sterility, the garment being provided with sleeves, and in its folded-out state having a front and back which are substantially alike and joined together at their edges, the folded-out garment having a length such that it at least covers the user's trunk, characterized in that the lower end portions of the front and the back of the folded garment inside the wrapping are folded backwards to form a collar round the entry opening of the garment, the outside of the collar being the inside of the folded-out garment, and the collar having a length in the longitudinal direction of the garment such that the presumptive user's hand can grip around the outer and folded end edges of the collar without the fingers reaching over the collar and coming into contact with the rest of the garment, and in that the folded garment inside the wrapping is folded such that the outer end portion of the collar is preferably folded sideways about at least one folding line parallel to the longitudinal direction of the garment.

2. Garment as claimed in claim 1, characterized in that the collar extends up to the sleeve area.

3. Garment as claimed in claim 1, characterized in that the sleeves are folded in towards each other and that the collar extends over the folded-in sleeves.

4. Garment as claimed in claim 3, characterized in that the lower end edges of the garment are each extended by an end flap and in that these flaps are folded outwards and back again over the front and back of the collar while leaving sufficient free surfaces on the collar at the sides of, and below the end flaps, so that these free surfaces can be gripped by the user's fingers when putting the garment on, said surfaces being on the inside of the garment after putting it on, putting on the garment being terminated, if required, by pulling the end flaps to stretch the garment on the user.

5. Garment as claimed in claim 1, characterized in that it is slit at least along a part of its side edges.

6. A garment in which the front and back of the garment are pleated, the pleats being transverse between the side edges of the garment to form a bellows-like packet, and the sleeves are turned so that their outsides are inside along their entire length and are pulled through the pleated packet, thereafter to be turned inside out along a portion of their free length from the ends of the sleeves to form two muffs having their ends outside both ends of the folded packet so that the user can insert his hands directly into the muffs at one side edge of the packet.

* * * * *